US006595216B1

(12) United States Patent
Wessinger

(10) Patent No.: US 6,595,216 B1
(45) Date of Patent: Jul. 22, 2003

(54) METHOD OF CUTTING SHEETS OF RECONSTITUTED TOBACCO

(75) Inventor: Eric W. Wessinger, Macon, GA (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 09/812,632

(22) Filed: Mar. 20, 2001

(51) Int. Cl.[7] ..... A24B 7/04; A24B 7/12

(52) U.S. Cl. ..... 131/117; 131/118; 131/370

(58) Field of Search ..... 131/108, 117, 131/118, 116, 322, 370, 374; 242/528; 83/29, 906, 650

(56) References Cited

U.S. PATENT DOCUMENTS

| | | | | | |
|---|---|---|---|---|---|
| 678,371 | A | * | 7/1901 | Bender | 83/264 |
| 1,874,902 | A | * | 8/1932 | Clyne | 83/339 |
| 2,066,566 | A | | 1/1937 | Janson et al. | |
| 2,646,832 | A | * | 7/1953 | Papendick | 83/594 |
| 2,769,734 | A | * | 11/1956 | Bandel | 131/355 |
| 2,975,483 | A | * | 3/1961 | Cooper et al. | 264/143 |
| 2,978,942 | A | * | 4/1961 | Casino | 83/107 |
| 3,186,277 | A | * | 6/1965 | Brunner | 241/222 |
| 3,324,753 | A | | 6/1967 | Lindau | |
| 3,584,668 | A | | 6/1971 | Neville | |
| 4,267,752 | A | * | 5/1981 | Byrt et al. | 83/311 |
| 4,369,797 | A | | 1/1983 | Brackmann et al. | |
| 4,456,018 | A | | 6/1984 | Brackmann et al. | |
| 4,542,755 | A | | 9/1985 | Selke et al. | |
| 4,369,797 | A | | 7/1987 | Brackmann et al. | |
| 4,700,720 | A | | 10/1987 | Ray | |
| 4,787,402 | A | * | 11/1988 | Leonard | 131/353 |
| 4,799,501 | A | * | 1/1989 | Liebe et al. | 131/299 |
| 4,960,020 | A | * | 10/1990 | Reinhard | 83/34 |
| 5,012,824 | A | | 5/1991 | Ray | |
| 5,143,095 | A | * | 9/1992 | Lasch et al. | 131/117 |
| 5,445,054 | A | | 8/1995 | Pryor | |
| 5,724,998 | A | * | 3/1998 | Gellatly et al. | 131/372 |
| 5,908,034 | A | * | 6/1999 | Adedeji | 131/297 |
| 5,913,958 | A | * | 6/1999 | Balsells Ventura | 83/649 |
| 5,974,928 | A | * | 11/1999 | Boldrini | 83/100 |

FOREIGN PATENT DOCUMENTS

| | | | |
|---|---|---|---|
| DE | 132536 | 7/1902 | |
| EP | 0 124 255 | 11/1984 | |
| GB | 1067448 | * 5/1967 | |
| GB | 1498668 | * 1/1978 | F16H/21/00 |
| GB | 2 066 649 | 7/1981 | |
| JP | 7-265043 | 10/1995 | |
| WO | WO 89/11802 | 12/1989 | |
| WO | WO 95/07031 | 3/1995 | |

* cited by examiner

*Primary Examiner*—Steven P. Griffin
*Assistant Examiner*—Carlos Lopez
(74) *Attorney, Agent, or Firm*—Charles G. Lamb; Middleton Reutlinger

(57) ABSTRACT

A process of cutting reconstituted tobacco includes (1) rolling up single sheets of reconstituted tobacco into a plurality of single sheet rolls of reconstituted tobacco, unrolling said sheets and wherein the unrolled sheets are laid on top of one another; or, (2) stacking a plurality of sheets orientated in layers and feeding said sheets to a cutting machine. The cutting machine includes a rotary drum having a plurality of controlled strand cutting knives spaced at preselected intervals along an outer periphery of the drum.

4 Claims, 4 Drawing Sheets

METHOD OF CUTTING SHEETS OF RECONSTITUTED TOBACCO

BACKGROUND OF THE INVENTION

This invention is directed to a process for cutting tobacco and more particularly to a process for cutting sheets of reconstituted tobacco with control-strand length knives.

In the manufacturing of smoking articles, and particularly cigarettes, tobacco leaves are generally aged at specific temperatures and humidity conditions for a preselected period of time. The tobacco leaves are then separated into lamina, stems and veins. The stems and veins are not suitable without further processing for use in a tobacco process. Thus, the stems, veins, dust, fines and other tobacco materials, which are not acceptable in a smoking article in their natural state, are then reprocessed into a tobacco product referred to as "reconstituted tobacco". In the manufacturing of reconstituted tobacco, a number of the undesirable chemical components that are normally in the tobacco may also be removed. The resulting reconstituted tobacco in sheet form is then acceptable for use in making a smoking article. Normally, these sheets of reconstituted tobacco are stored with tobacco lamina prior to any processing and then the reconstituted tobacco sheets are processed along with the tobacco lamina.

In the cutting of tobacco lamina, one particular reference of interest is Brackmann et al, U.S. Pat. No. 4.369.797 issued Jan. 25, 1983 which teaches a feed mechanism for a tobacco cutting machine for tobacco lamina wherein the lamina is fed in horizontal layers and cut with a rotary drum cutter.

SUMMARY OF THE INVENTION

It is an object of the present invention to provide an improved process for cutting sheets of reconstituted tobacco allowing it to be blended with cut tobacco.

It is another object of the present invention to provide a method for cutting reconstituted tobacco which allows the capacity of a primary tobacco processing facility that processes reconstituted tobacco with lamina tobacco to be increased without modifying or replacing processing equipment.

It is even a further object of the present invention to provide a process which reduces attrition of reconstituted tobacco.

In carrying out the process of the present invention, a multiple-layer stack of sheets of reconstituted tobacco in a semi-continuous or continuous web is fed directly to a tobacco cutting device wherein the tobacco cutting device is a rotary drum cutter having controlled-strand length knives disposed along the outer periphery thereof for cutting the sheets of tobacco into well defined strands.

More particularly, the present invention provides a process for cutting reconstituted tobacco using sheets having a width approximately equal to the width of the mouth opening of a tobacco cutter to produce rolls of sheets by rolling up single sheets, then simultaneously unrolling a plurality of said rolls of sheets such that they are laid on top of one another; or alternatively, using sheets having a width approximately equal to the width of the mouth opening of a tobacco cutter then placing a plurality of said sheets on top of each other in an unrolled condition. The sheets of the reconstituted tobacco are then fed into a compression band of a tobacco cutter and a preselected amount of cut reconstituted tobacco is then blended with a preselected amount of cut tobacco for further processing.

BRIEF DESCRIPTION OF THE DRAWINGS

A better understanding of the invention will be had upon reference to the following detailed description of the preferred embodiments and to the several views illustrated in the drawings wherein like numerals refer to like parts throughout the several views and wherein.

DETAILED DESCRIPTION OF THE PREFERRED EMBODIMENT

Figure 1:
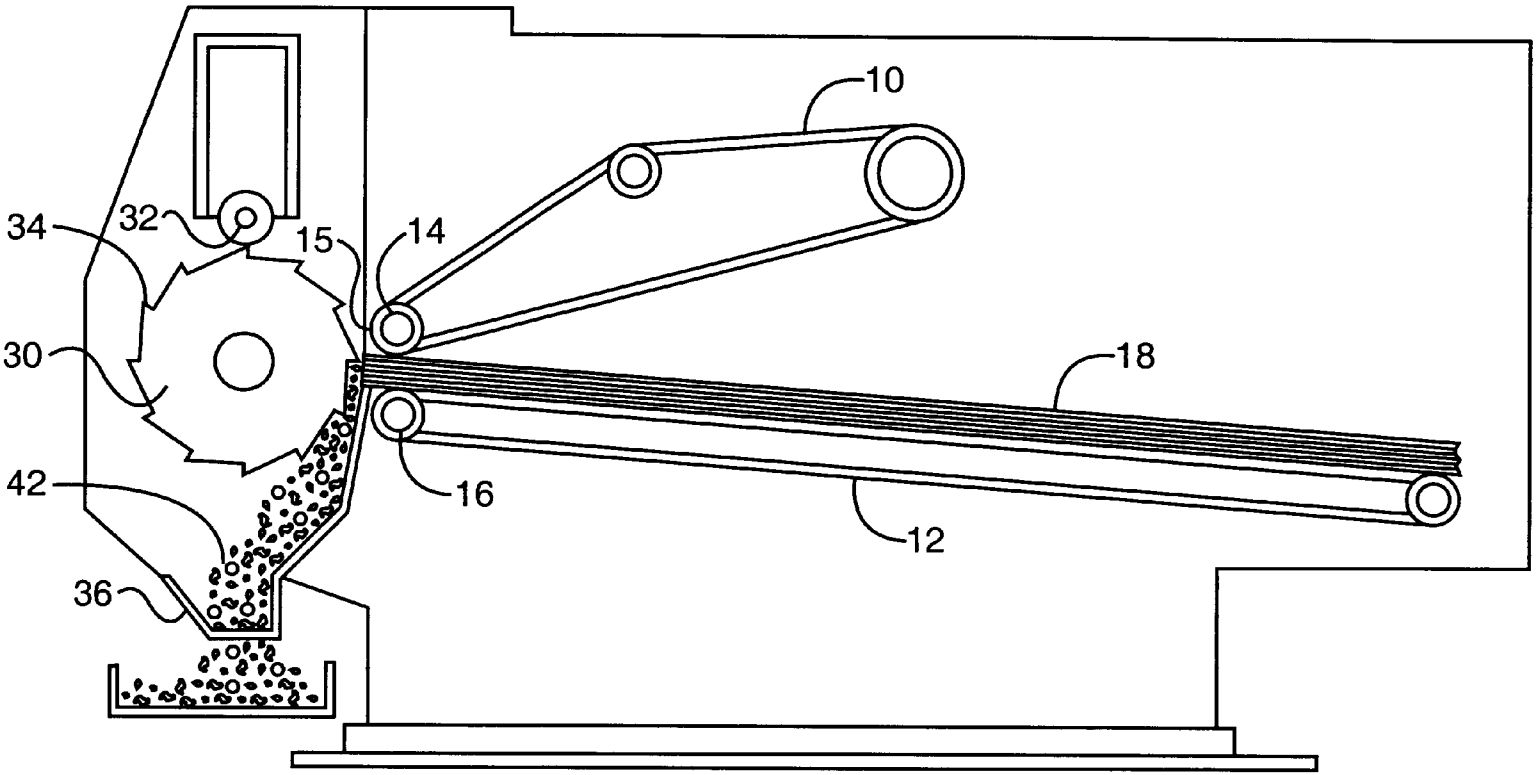
FIG. 1 is a schematic side elevational view of one preferred cutting apparatus used in accordance with the present invention.

In FIG. 1 is shown a multiple layered stack of reconstituted tobacco sheets 18 being fed by a lower conveyor 12 to a rotary cutting drum 30. The lower conveyor 12 moves upwardly to converge with an upper conveyor 10 at the downstream end for feeding the rotary cutter 30. A throat 15 at the downstream end is defined by upper and lower pressure plates 14 and 16 which are mounted to apply pressure to the multiple layer stack of reconstituted tobacco 18 as it passes therethrough.

The rotary drum cutter 30 includes a plurality of cutting knives 34 which are mounted for cutting shreds of tobacco 42 from the multiple layer of reconstituted tobacco sheets 18. The spacing between knives 34 is substantially equal to the width of the mouth opening into a tobacco cutter, which is well known in the art. The tobacco shreds 42 are caught in a hopper 36 which feeds a discharge conveyor, drums, or the like, for further processing or blending with other types of tobacco in a cigarette smoking article or the like.

Also, a grinding wheel 32 is mounted above the rotary cutter 30 for traversing along the knives as they rotate. As depicted, either knife 134 or knife 34 may be placed on either rotary drum depicted in the figures depending on the environment, operating circumstances or other parameters needed to be achieved by the design of the present invention.

Figure 2:
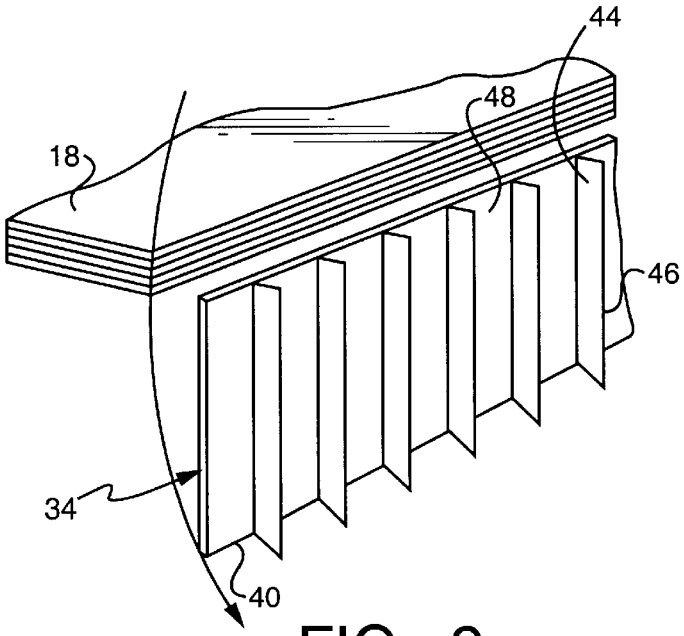
FIG. 2 is a partial sectional view of one preferred controlled-strand length cutting knife of FIG. 1.
Figure 5:
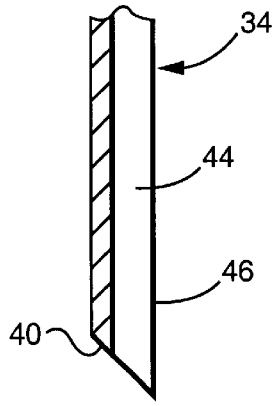
FIG. 5 is a side view of the cutting knife of FIG. 2.

In FIGS. 2 and 5 is shown one particular cutting knife 34 for attachment to a rotary cutter 30. The knife 34 is provided with a lower transversely extending cutting edge 40 which extends substantially the entire width of the layer of reconstituted tobacco sheets 18. Spaced along the cutting knife 34 are a plurality of outwardly extending blade portions 44 having longitudinally extending cutting edges 46. The spacing 48 between the cutting blade portions 44 define the length of the strands of reconstituted tobacco shreds 42 exiting from the rotary drum 30.

Figure 3:
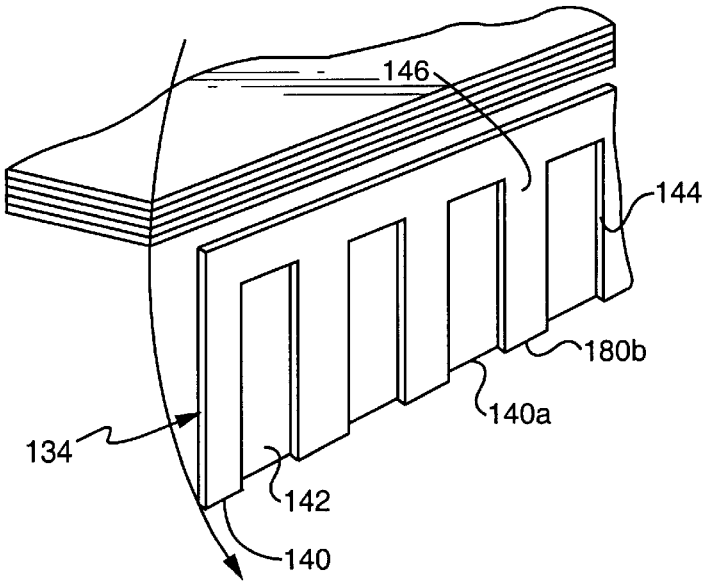
FIG. 3 is a sectional view, in perspective, of another controlled-strand length cutting knife used in the cutting apparatus of FIG. 1.
Figure 6:
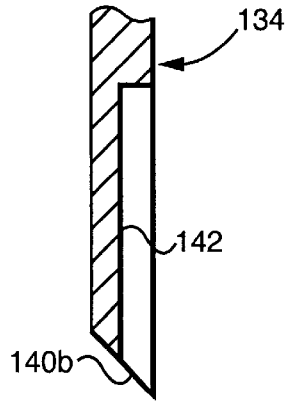
FIG. 6 is a side view of the cutting knife of FIG. 3.

FIGS. 3 and 6 show another cutting knife 134 for attachment to a rotary cutter. The knife 134 is beveled at one side and is provided with rectangular section grooves 142 which are cut at right angles to the cutting edge in the face of the knife which is not beveled. The grooves 142 produce a crenellated cutting edge 140 with alternate leading cutting edges 140*a* and 140*b*. Beveled cutting edge 140 extends across both end surfaces 140*a* and 140*b* as depicted in the drawings.

Figure 4:
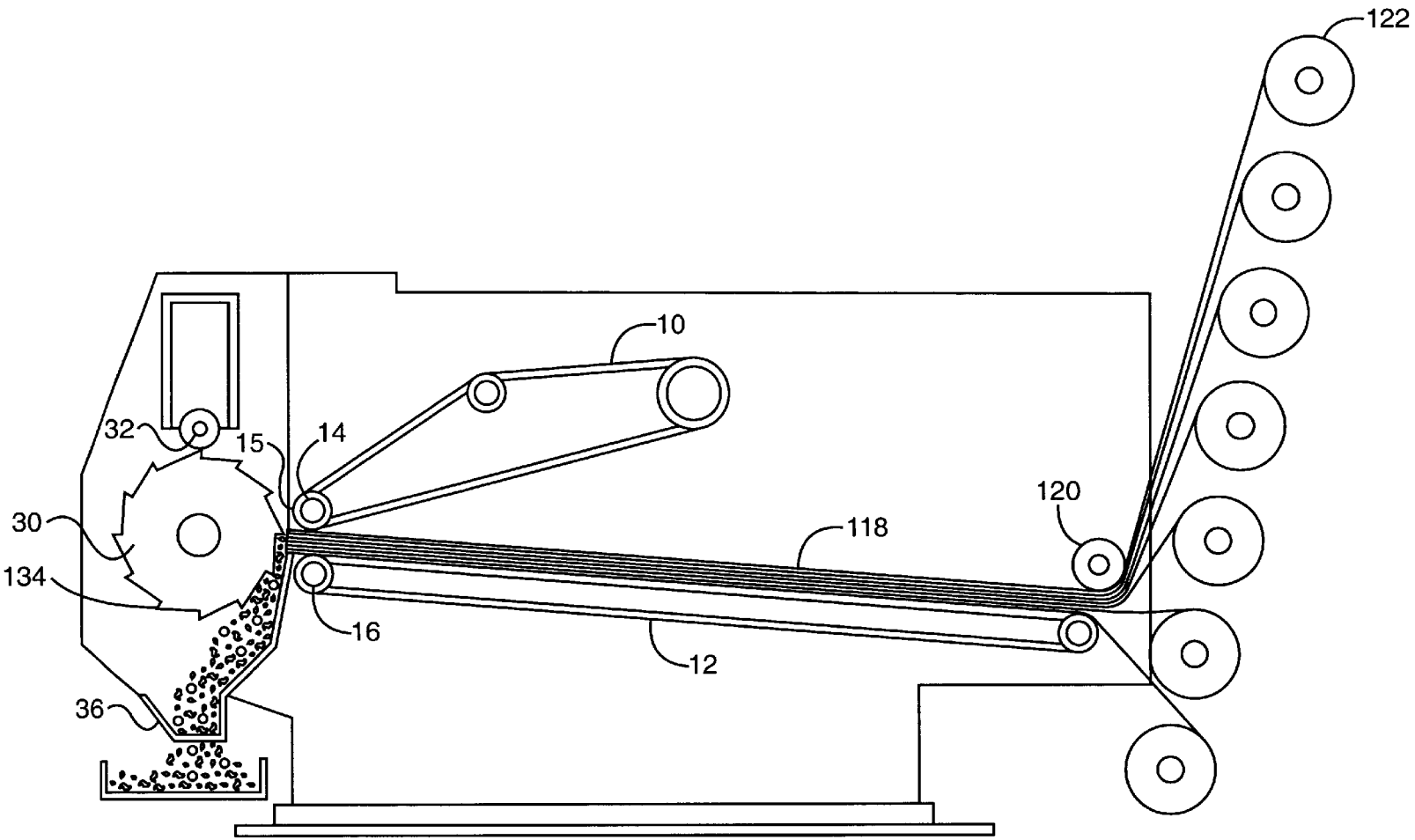
FIG. 4 is a schematic side elevational view of another preferred reconstituted tobacco cutting apparatus in accordance with the present invention.

FIG. 4 shows an apparatus for cutting reconstituted tobacco in the same manner as the multiple layer of sheets 18 being cut in FIG. 1, but includes a stack of a plurality of sheets 118 which are formed from continuous rolls 122 of reconstituted tobacco as opposed to the cut sheet shown in FIG. 1. In FIG. 4 a guide roller 120 is spaced above the feed end of the lower conveyor 12 to assist in the alignment of the sheets 118.

Figure 7:
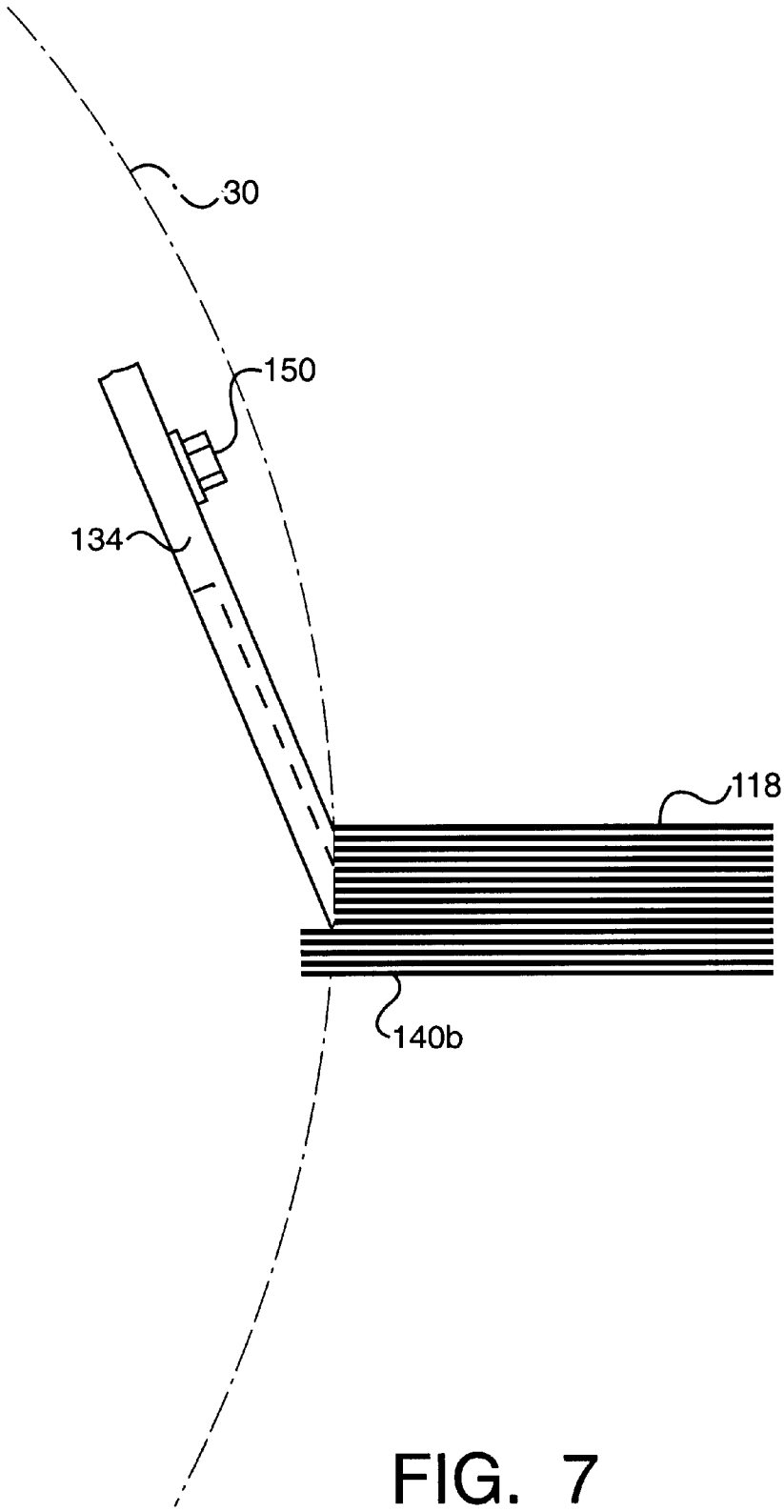
FIG. 7 is a schematic cross-section showing the cutting of a multiple layer stack of reconstituted tobacco by a rotary cutting drum.

FIG. 7 shows one attachment of a cutting knife to a rotary drum 30 which is outlined in phantom lines. Knife 134 with the lower cutting edge 140*b* is in contact with stacked sheets of reconstituted tobacco 118 may be attached to the rotary drum by any desired means, but is shown as being attached with bolt means 150.

It is realized that other cutting knives of different configurations may be utilized in the present invention as long as the cutting blades are provided with cutting edges at selected intervals to provide the cuts or strands of tobacco of selected length. The width of the strands is achieved by adjustment of the tobacco cutting machine, which is well known in the art.

What is claimed is:

1. A method of cutting reconstituted tobacco comprising the steps of:

feeding stacked cut reconstituted tobacco sheets orientated in layers to a cutting machine; and cutting said layers in said cutting machine, to a preselected length of strands of reconstituted tobacco, said cutting machine comprising a rotary drum having a plurality of controlled-strand length cutting knives spaced at preselected intervals along an outer periphery of said drum.

2. The method of claim 1 wherein each of said controlled-strand length cutting knives includes a transversely extending cutting edge extending a width of said sheets, each of said knives including a plurality of spaced outwardly extending blade portions having longitudinally extending cutting edges.

3. The method of claim 1 wherein each of said controlled-strand length cutting knives includes a beveled cutting edge at one side and a plurality of grooves of rectangular configuration, said grooves being at right angles to a cutting edge in a face of the knife which is not beveled.

4. The method of claim 1 wherein said feeding includes a feeder which comprises an upper and a lower conveyor converging with a defined spacing therebetween to feed said reconstituted tobacco to said cutting machine.

* * * * *